US005256074A

United States Patent [19]

Tan et al.

[11] Patent Number: 5,256,074

[45] Date of Patent: Oct. 26, 1993

[54] CONNECTOR HAVING IMPROVED ELECTROSTATIC DISCHARGE PROTECTION

[75] Inventors: Haw-Chan Tan, Diamond Bar; Renee Chiang, Long Beach, both of Calif.

[73] Assignee: Foxconn International, Inc., Sunnyvale, Calif.

[21] Appl. No.: 886,070

[22] Filed: May 20, 1992

[51] Int. Cl.[5] ..... H01R 4/66

[52] U.S. Cl. ..... 439/108; 439/607

[58] Field of Search ..... 439/95, 96, 108, 188, 439/507, 514, 607, 751

[56] References Cited

U.S. PATENT DOCUMENTS 3,694,792 9/1972 Wallo ..... 439/751 X 4,711,506 12/1987 Tanaki ..... 439/108

*Primary Examiner*—Eugene F. Desmond

[57] ABSTRACT

A female connector (10) includes a housing (11) comprising an elongated base (12) and a trapezoidal island (14) protruding forward from the base (12). A plurality of two-row passageways (16) extend through the housing (11) to receive a plurality of corresponding contacts (18) therein. A groove (19) transversely through a front surface (13) of the island (14) and further backward extends along and through two side surfaces (15) of the island (14) until it reaches the base (12). A conductive shell (20) includes a plate (22) to cover the base (12) of the housing (11), and a circumferential fence (24) to receive the island (14) of the housing (11) therein. A blade type conductive member (30) having an elongated flat body (31) positioned within the groove (19) and a pair of legs (34) extending backward and obliquely outward from two ends of the flat body (31) to resiliently engage the conductive shell (20) for ESD protection.

15 Claims, 2 Drawing Sheets

CONNECTOR HAVING IMPROVED ELECTROSTATIC DISCHARGE PROTECTION

BACKGROUND OF THE INVENTION

1. Field of the Invention

The present invention relates to a connector, particularly to a female connector having improved electrostatic discharge protection.

2. Description of the Prior Art

A large amount of electrostatics may be accumulated by a human body when the ambient relative humidity drops to 50% or below. In this situation, it is possible for a person to build up electrostatic charges and inadvertently have electrostatic discharges (ESD) occur wherever he touches. For consideration of handling and manual operation, most electrical components are recommended to establish grounding paths on their surfaces for protect the inner integrated circuits due to susceptibility to damage from ESD.

Some efforts have been made before to establish a grounding trace or install an additional module on the inner circuit board to protect the main circuit thereon as disclosed in U.S. Pat. Nos. 4,667,266 and 4,477,134. Recently, the grounding effect is intended to be directly established outside. As disclosed in U.S. Pat. Nos. 4,532,419, 4,531,176, 4,824,377 and 4,955,817, a grounding path protruding beyond the contacts or the circuit pads can easily catch an electrostatic discharge thereon, if any, and protect the inner connected circuits from ESD.

It can be seen this type ESD protection is a very simple way which uses a unitary conductive member encircling or protruding beyond the contacts or terminals so that the hand will not easily touch the contacts or the terminals without contacting that conductive member first, thus the grounding path functioning thereof and preventing any electrostatic discharges from directly occurring on the contacts or the terminals. In accordance with the foregoing description, ESD protection principle applied to the electrical component is easy, but it is deemed useful and practical.

The present invention is to provide an improvement of the female connector disclosed in U.S. Pat. No. 4,824,377. In that prior art connector, a wire has been introduced to be mounted on the front surface of the insulator so that an electrostatic discharge directed towards the conductive pins of the female pin connector when not connected to a mating plug will be discharged through said conductive wire and grounding terminal rather than being discharged to the contacts of the female pin connector. Although the wire can achieve ESD protection, these are still some shortcomings as follows.

First, the wire is not easily fixedly mounted on the insulator, and may be floating on, even dropped from, the insulator due to sudden vibration imposed on its poor securement. By the way, using other methods such as adhesion or printing of the conductive member are less economic than securement via a simple mechanical structure. Secondly, it is not easy to handle a thin wire for installation on the insulator, and this will increase difficulties in automation assembling. Thirdly, it is not easy to control a properly sufficient engagement between the wire and the conductive shell which is connected to a grounding terminal, such that the possible poor engagement may jeopardize grounding effect of ESD protection. Additionally, it is not convenient to configure the specific height of the wire beyond the front surface of the insulator, while that height may be designedly different to accommodatingly correspond to the different dimensioned connectors. Also, although the wire is expected to have a sharp edge with relatively small radii for increasing surface charge density, it is not easy for the wire to configure the same.

Accordingly, it is desirable to provide an improved construction for a connector which can eliminate these disadvantages of the prior art connector and achieve a better ESD protection function in either operation or manufacturing.

It is an object of the present invention to provide a specific type ESD protection means on a connector, which can be easily and fixedly mounted to the connector and keep an electrically close and sufficient engagement thereof for grounding.

Another object of the present invention is to provide an ESD protection means which can easily not only be assembled to the connector by automation assembling, but also be shaped to have a sharp edge or a proper height to accommodate the associated connector.

SUMMARY OF THE INVENTION

In accordance with the present invention, an electrical female connector has an insulative housing, and a conductive shell partially covering the insulative housing. A plurality of passageways extends through the insulative housing, in which a plurality of corresponding contacts are received. A blade type conductive member mounted to the front surface of the insulative body, has an elongated flat body vertically lengthwise positioned within a groove of the front surface of the housing. Two legs backward and slightly outward extend from two ends of the body of the conductive member, respectively, and each is compactly sandwiched between the side surface of the housing and the side wall of the shell where each leg resiliently engages and presses the side wall of the conductive shell such that a reliably sufficient engagement is provided thereon and a grounding path is well established.

The bottom portion of each leg abuts against the inward extending flange of the conductive shell so that it is impossible for the conductive member to drop out of the housing.

DESCRIPTION OF THE PREFERRED EMBODIMENT

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
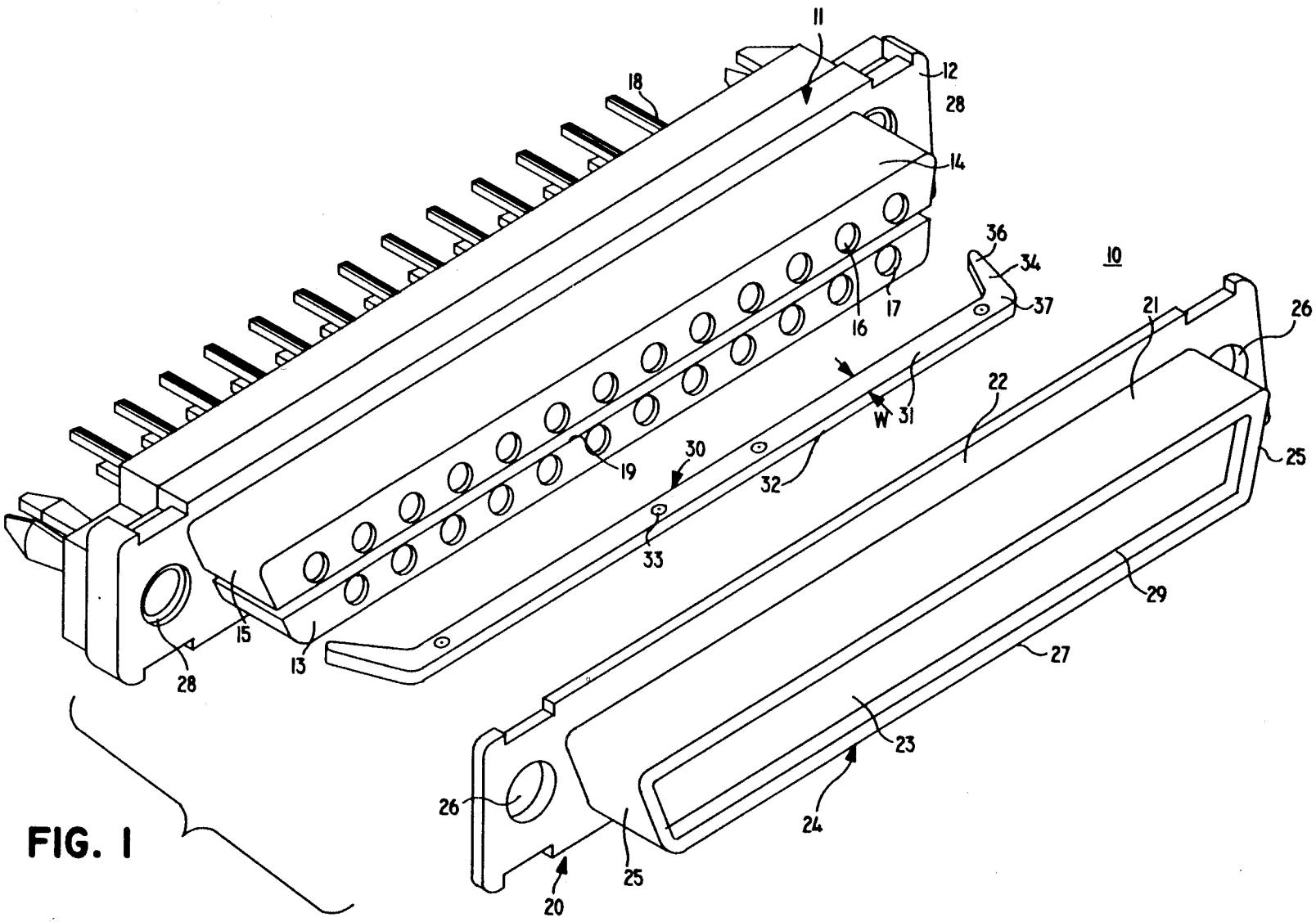
FIG. 1 is an exploded perspective view of a connector in accordance with the present invention.

Referring to FIG. 1, the subject female connector 10 of D-Sub type which includes a housing 11 comprising an elongated base 12 and a trapezoidal island 14 protruding forward from the base 12. A plurality of two-row passageways 16 extend through the housing 11 to receive a plurality of corresponding contacts 18 therein. Each passageway 16 also defines an outward opening 17 to receive a male contact pin which will be inserted into the corresponding contact 18 in the passageway 16.

A groove 19 of a depth transversely extends through a front surface 13 of the island 14 between the two rows of the openings 17 of the passageways 16. The groove 20 further backward extends along and through two side surfaces 15 of the island 14 until it reaches the base 12.

A conductive shell 20 includes a plate 22 dimensioned to correspond to the base 12 of the housing 11. The conductive shell 20 has a central opening (not shown) to have the island 14 of the housing 11 pass through and a circumferential fence 24 extends forward from the edge of the central opening. The fence 24 of the shell 20 receives the island 14 of the housing 11 therein when the shell 20 and the housing 11 are combined together by a pair of screws (not shown) through the holes 26 and 28 respectively positioned at two ends of the shell 20 and the housing 11.

The fence 24 includes a top wall 21, a bottom wall 23, and two side walls 25, and defines a circumferential flange 29 inward extending from an outward edge 27 of the fence 24.

A blade type conductive member 30 having an elongated flat body 31 is positioned within the groove 19 and a front edge 32 of the conductive member 30 protrudes out of the front surface 13 of the island 14. The conductive member 30 further integrally includes a pair of legs 34 extending backward and outward from two ends but still in the same plane with the flat body 31. Each leg 34 has a tapered free end 36 to enhance resilience thereof. Four embossments 33 are positioned on the surface of the body 31 of the conductive member 30 for interference engagement with the groove 19.

When assembled, two ends of the conductive member 30 abut against the corresponding portion of the flange 29, thus preventing the conductive member 30 from being dropped out of the island 14. Additionally, the interference engagement between the embossments 33 and the groove 19 also provide securement for conductive member 30. By deeming the fixed end 37 of the leg 36 as a support point, the free end 36 of each leg 34 is inward compressed against the corresponding side wall 25 of the fence 24 and forced to be received in the groove 19 on the side surface 15, thus assuring a reliably compact engagement between the conductive member 30 and the conductive shell 20 to provide a grounding path. It can be understood that the depth of the groove 19 may be slightly smaller than the width W of the conductive member 30, so it assures the front edge 32 of the conductive member 30 protrudes out of the front surface 13 of the island 14 for attraction of static charges. Also, the middle section of the front edge 32 can be designed to extend forward a distance and be flush with or little beyond the flange 24 so that it is impossible for a person to reach the passageway openings 17 into which a contact 18 is inserted without touching either the conductive member 30 or the conductive shell 20. As a result, any static resulting from the person will be removed through this grounding path and not invade the contacts 18 received in the passageways 16. It can also be seen that the reason why the blade type conductive member is named results from the entire conductive member being substantially lengthwise of a blade type and having a straight side plane along its entire length wherein the straight side plane comprises and is coplanar with the surface of the flat body.

Figure 2:
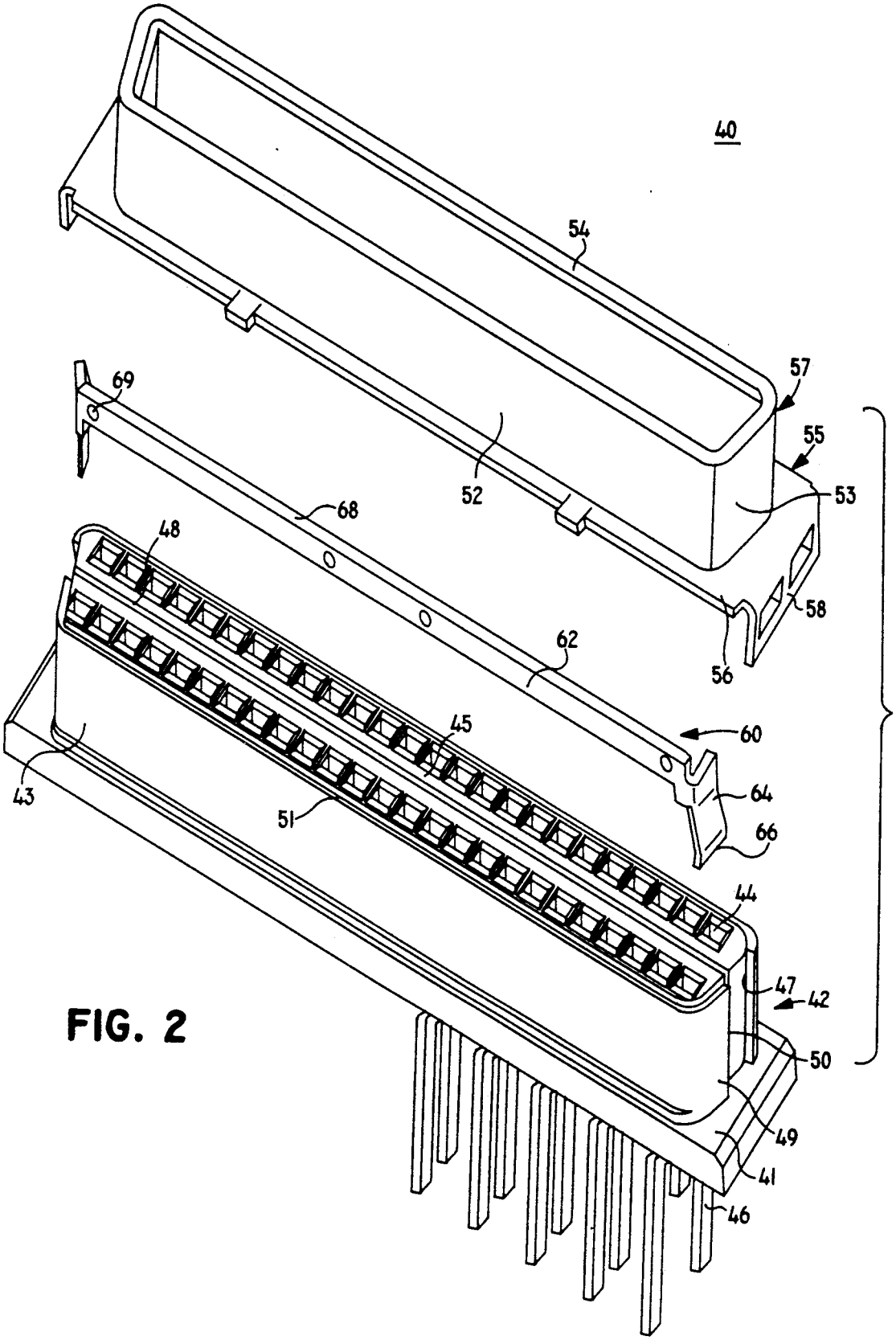
FIG. 2 is an exploded perspective view of a connector assembly of another embodiment in accordance with the present invention.

FIG. 2 is another embodiment of the present invention to show the relative structure of the blade type conductive member applied to an SCSI type connector. As shown in FIG. 1, the D-Sub type connector 10 has a sufficient space to install the groove 19 on the side surface 15 of the housing 11 but the SCSI type connector does not. Because the SCSI connector is of high density contact arrangement, there is no space on the side surface of the housing to install the groove 19 of a depth as disclosed in FIG. 1. Accordingly, in the SCSI type connector, a different laterally extending recess is disposed on the side surface of the housing in place of the deeper groove.

Referring to FIG. 2, the subject connector assembly 40 includes a housing 42 comprising a base 41 and an island 43 extending upward thereon. A plurality of two-row passageways 44 extend through the housing 42 to receive a corresponding number of contacts 46 therein. Between the two rows of the passageways 44 a groove 48 of a depth extends along the entire length of a top surface 45 of the island 43. Two recesses 47 each extends along the entire length of the side surface 49 of the island 43, of which a side edge 50 is aligned with the groove 48. A peripheral slot 51 is positioned at the edge of the front surface 45.

A conductive shell 55 includes a plate 56 covering the base 41 of the housing 42, and a circumferential fence 57 protruding upward to surround the island 43 when assembled. The fence 57 includes a two lengthwise walls 52 and two side walls 53 which together define a circumferential flange 54 extending inward from an outer edge thereof. Two tabs 58 downward extend at two opposite ends of the plate 56 to engage a bracket (not shown) which fastens the shell 55 and the housing 42 thereto.

An elongated blade type conductive member 60 comprises a flat body 62 positioned within the groove 48 wherein a top edge 68 of the flat body 60 protrudes little beyond the top surface 45 of the island 43. Two downward strip type legs 64 lateral and integrally extend from two ends of the body 60 by bending so that each leg 64 is connected to the end of the flat body along a portion of a longitudinal edge of the leg and the leg is perpendicular to the flat body. In this situation, the free end 66 of each leg 64 is biased outward to press against the conductive shell 55 and the flat body 60 is much longer than the leg 64. Four embossments 69 are positioned on the surface of the flat body 60 for interference engagement with the groove 48 of the housing 42.

When assembled, the conductive member 60 is inserted into the groove 48 from the top whereby the top edge 68 of the flat body 60 slightly protrudes out of the top surface 45 of the island 43, and the legs 64 are received within the recesses 47 on the side surfaces 49 of the island 43. The conductive member 60 covers the housing 42 wherein the circumferential flange 54 occupies the slot 51 such that the flange 54 is generally flush with the top surface 45 of the housing 42. Each leg 64 of the conductive member 60 abuts against the corresponding side wall 53 of the conductive shell 55 because of the resilience of its biased free end 66. The flange 54 and the embossments 69 prohibit the upward movement of the conductive member 60 and as a result, the conductive member 60 is fixedly mounted to the housing 42. At the same time, the abutment between the legs 64 of the conductive member 60 and the side walls 53 of the conductive shell 55 provides a grounding path for any possible ESD resulting from a person such that static charge through hands will hardly invade the contacts which are positioned within the passageways 44.

Because the conductive member 30 or 60 is of a blade type, it can be very thin to form a sharp edge on its outer edge for enhancement of surface charge density. Also, it is easy to adjust the position of the blade type conductive member in the groove to reveal a proper height for accommodation with different situations due to different connectors.

It can be noted that the present invention provides the connector with a specific conductive member 30 or 60 of a blade type having a pair of laterally and obliquely outward extending legs 34 or 64 at two opposite ends to engage the conductive shell 20 or 55 which incorporates with the housing 11 or 42 to compactly sandwich the legs 34 or 64 therebetween. This ensures a reliable engagement between the conductive member 30 or 60 and the conductive shell 20 or 55 for an ESD path. The blade type conductive member 30 or 60 is also easier to be installed. Embossments 33 or 69 positioned on the flat body 31 or 62 of the conductive member 30 or 60 engaging a groove 19 or 48, and a circumferential inward flange 29 or 54 abutting against fixed ends of the legs 34 or 64 of the conductive member 30 or 60, both of them fixedly secure the conductive member 30 or 60 to the housing 11 or 42 without the possibility of outward movement or withdrawal therefrom. In brief, the present invention provide a compact structure of the conductive member which can not only easily and precisely fastened to the housing, but also well and reliably engage the conductive shell to perform a grounding path.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claims.

What is claimed is:

1. A female connector including:

an insulative housing comprising an elongated base, an island protruding forward from the base, and two rows passageways extending therethrough to receive a plurality of corresponding contacts therein;

a conductive shell including a plate covering the base of the housing, and a circumferential fence covering the island of the housing; wherein the improvement includes:

said island of the housing defining a front surface and two side surfaces whereby between two rows of the passageways a groove of a depth extends along an entire length of the front surface of the island and successively backward extends along the side surfaces of the island;

said circumferential fence defining two side walls;

a unitary blade type conductive member having an elongated flat body defining a width positioned within the groove on the front surface of the island wherein at least one embossment is positioned on the flat body for interference engagement with the groove, and a pair of legs extending backward and obliquely outward from two ends of the flat body so that when assembling, a free end of each leg is pressed inward to be received within the groove on the side surface of the island and to provide an electrically reliable engagement with the corresponding side wall of the fence of the conductive shell for a grounding path.

2. The female connector as described in claim 1, wherein the groove on the side surfaces of the island extends therethrough until reaching the base.

3. The female connector as described in claim 1, wherein the fence of the conductive shell further comprises a circumferential flange extending inward from an outer edge thereof.

4. The female connector as described in claim 1, wherein the flat body and the legs of the conductive member lie at a same plane.

5. The female connector as described in claim 3, wherein the flange of the fence abuts against a fixed end of each leg for preventing the conductive member from outward moving.

6. The female connector as described in claim 1, wherein the width of the blade type conductive member is slightly larger than the depth of the groove.

7. The female connector as described in claim 1, wherein the free end of the leg has a reduced dimension.

8. The female connector as described in claim 1, wherein each side walls engages the free end of each leg of the conductive member so that each leg is compactly sandwiched between the side wall of the conductive shell and the side surface of the island.

9. A female connector assembly including:

an insulator housing comprising an elongated base, an island extending upward thereon, and two rows passageways extending therethrough to receive a plurality of corresponding contacts therein;

a conductive shell including a plate covering the base of the housing, and a circumferential fence covering the island of the housing; the improvement which comprises:

said island of the housing defining a top surface and two side surfaces whereby between two rows of the passageways a groove of a depth extends along an entire length of the top surface of the island, two recesses each extending along the side surface of the island, of each recess a side edge being aligned with the groove;

a unitary blade type conductive member having an elongated flat body positioned within the groove of the island wherein at least one embossment is positioned on the flat body for interference engagement with the groove, and a pair of legs laterally extending downward from two ends of the flat body, respectively, for positioning within the corresponding recesses of the island, a free end of each leg protruding obliquely outward to provide resilience, whereby when assembling, the free end of each leg is pressed inward to be received within the corresponding recess on the side surface of the island and provides an electrically reliable engagement with the fence of the conductive shell for facilitating a grounding path.

10. The female connector assembly as described in claim 9, wherein each recess extends along the entire length of the side surface.

11. The female connector assembly as described in claim 9, wherein each leg is generally perpendicular to the flat body, and a depth of the recess is similar to a thickness of the conductive member.

12. The female connector assembly as described in claim 9, wherein the fence of the conductive shell further comprises a circumferential flange extending inward from an outer edge thereof, and a peripheral slot is positioned at an edge of the top surface to receive said flange of the conductive member therein.

13. The female connector assembly as described in claim 9, wherein the fence of the conductive shell defines two side walls to engage the free ends of the legs of the conductive member.

14. A unitary conductive member used with a female connector for ESD protection including:

an elongated flat body defining an outer edge and having a plurality of embossments on a surface which defines a width thereof;

a pair of legs respectively extending from two ends of the flat body and opposite to the front edge, a free end of each leg protruding obliquely outward to provide a resilient force in engagement with a conductive shell of the female connector, wherein said entire conductive member is substantially lengthwise of a blade type having a straight side plane along its entire length, and said straight side plane comprises and is coplanar with the surface of the flat body.

15. A unitary conductive member used with a female connector for ESD protection including:

an elongated flat body defining a top edge and having a plurality of embossments positioned on a surface thereon; and at least one leg integrally extending, opposite to the top edge, downward from one end of said flat body, a free end of each leg protruding obliquely outward to provide a resilient force in engagement with a conductive shell of the female connector; wherein said leg of a strip type is laterally connected to the end of said flat body along a portion of a longitudinal edge of said leg, the flat body is much longer than the leg, and the leg is perpendicular to the surface of the flat body.

* * * * *